US006199351B1

(12) United States Patent
Mount

(10) Patent No.: US 6,199,351 B1
(45) **Date of Patent: *Mar. 13, 2001**

(54) PACKAGING MACHINE

(75) Inventor: Michael John Mount, Middlesex (GB)

(73) Assignee: Wright Machinery Limited, Uxbridge (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/951,389

(22) Filed: Oct. 16, 1997

(30) Foreign Application Priority Data

Oct. 16, 1996 (GB) ..... 9621609

(51) Int. Cl.[7] ..... B65B 1/02
(52) U.S. Cl. ..... 53/563; 53/570; 53/386.1
(58) Field of Search ..... 53/450, 550, 451, 53/551, 468, 563, 570, 469, 386.1, 374.4, 374.5, 373.7, 375.9, 389.3

(56) References Cited

U.S. PATENT DOCUMENTS

| | | | | |
|---|---|---|---|---|
| 3,264,794 | | 8/1966 | Brown et al. . | |
| 3,855,907 | * | 12/1974 | Johnson et al. | 53/469 |
| 4,021,283 | * | 5/1977 | Weikert | 53/469 |
| 4,171,605 | | 10/1979 | Putnam, Jr. et al. | 53/552 |
| 4,319,443 | * | 3/1982 | Watts, Jr. | 53/466 |
| 4,715,166 | * | 12/1987 | Kameda | 53/374.4 |
| 5,058,364 | * | 10/1991 | Seiden et al. | 53/570 |
| 5,067,306 | * | 11/1991 | Umezawa | 53/551 |
| 5,095,960 | | 3/1992 | Gründler et al. | 141/114 |
| 5,255,497 | * | 10/1993 | Zoromski et al. | 53/551 |
| 5,279,095 | | 1/1994 | Müller | 53/386.1 |
| 5,279,098 | * | 1/1994 | Fukuda | 53/551 |
| 5,555,709 | | 9/1996 | Savigny et al. | 53/570 |
| 5,590,511 | * | 1/1997 | Morrison | 53/374.4 |
| 5,715,647 | * | 2/1998 | Keim et al. | 53/551 |
| 5,755,082 | * | 5/1998 | Takahashi et al. | 53/551 |

FOREIGN PATENT DOCUMENTS

| | | |
|---|---|---|
| 681445 A5 | 3/1993 | (CH) . |
| 1 283 139 | 11/1968 | (DE) . |
| 21 31 126 | 1/1973 | (DE) . |
| 25 20 269 | 11/1976 | (DE) . |
| 28 41 837 | 5/1979 | (DE) . |
| 0 404 719 A1 | 12/1990 | (DE) . |
| 0 685 391 A1 | 12/1995 | (DE) . |
| RS 97647 | 11/1996 | (EP) . |

* cited by examiner

*Primary Examiner*—Eugene Kim
(74) *Attorney, Agent, or Firm*—Darby & Darby

(57) ABSTRACT

A packaging machine is described for forming, filling and sealing bags with a product. The machine forms a film into an elongate, side-sealed tube as it travels in a first direction, and severs the elongate tube into individual, open-ended, bag-length elements. These are then transported in a second direction transverse to the first direction, and a bottom seal formed on them to convert them into open-topped bags. A carousel is arranged to receive the open-topped bags. Product is introduced into each of the open-topped bags, and a top seal formed on each of them to convert them into filled, sealed bags, as the bags travel round the carousel.

27 Claims, 18 Drawing Sheets

PACKAGING MACHINE

BACKGROUND OF THE INVENTION

1. Field of the Invention

This invention relates to a packaging machine and, more particularly, to a machine for packaging snack products (e.g. potato crisps) and other low density materials. A typical use would be to package 30 g portions of crisps in bags 127 mm wide and 178 mm long.

2. Discussion of the Related Art

There is a limit to the speed at which a conventional vertical, form, fill and seal machine can package snacks and other lightweight products. The speed is limited by the maximum rate at which the product can fall and the length of time needed to heat seal the film.

SUMMARY OF THE INVENTION

The present invention uses a method in which the packs preferably travel round on a carousel. Hence much more time is available for the processes involved in forming and filling the bag and the machine operations are less interdependent.

Filling by means of a rotating carousel is already widely used with rigid containers such as in the canning industry, and to a lesser extent with flexible packaging.

Two particular instances of machines which have carousels for the filling of flexible packaging are:

a) A machine produced by Jones & Co. Inc. of Cincinnati, Ohio 45201, USA. In this machine, a reel of flat film is folded longitudinally and then divided into sections by sealing. The pouches so formed have three closed edges and are still joined to one another. The string of pouches passes round a carousel, where product is introduced from a number of chutes. The top seal is then made and the pouches are cut from each other. This type of filling is suited to heavier products such as soups, rice or confectionery, and is in use elsewhere.

b) A machine produced by Thurlings Verpackungsmaschinen GmbH, of D-41749 Viersen, Germany. With this machine, the film is made into bags by conventional vertical, form, fill and seal means (film unwind, tubeformer, vertical seal and jaws). Only one end of each bag is sealed and the open bags already separated from one another, are then transferred to a rotating turret by means of vacuum operating suckers. The turret has a number of stations, each with a number of fingers, which project into each bag and open to hold it in position. The turret indexes round and product is introduced by a chute. After the bag has left the carousel, its top seal is made.

According to a first aspect of the present invention there is provided a packaging machine for forming, filling and sealing bags with a product, which comprises means for forming a film into an elongate, side-sealed tube as it travels in a first direction, means for severing the elongate tube into individual, open-ended, bag-length elements, means for transporting the said elements in a second direction transverse to the first direction, means for forming a bottom seal on said elements to convert them into open-topped bags, a carousel arranged to carry the open-topped bags, and means for introducing product into each of the open-topped bags and for forming a top seal on each of the bags to convert them into filled, sealed bags, as the bags travel round the carousel.

According to another aspect of the invention there is provided a machine for forming a film of heat-sealable film into an elongate, side-sealed tube, comprising a tubeformer for forming the film into shape of a tube with overlapping longitudinal edge portions as it travels from a film supply, inner and outer pressure members which engage the inside and outside of the said edge portions and travel with them, and means for applying heat to the said edge portions.

According to a further aspect of the invention there is provided a device for use in filling open-topped bags with a product, comprising fingers adapted to enter and hold the open top of each bag, and a chute formed of a plurality of members which are movable with respect to one another from a configuration in which the chute can enter the open bag top to an expanded configuration in which product can enter the bag therethrough.

Other aspects of the invention appear from the claims.

BRIEF DESCRIPTION OF THE DRAWING

The invention will now be described with reference to the accompanying drawings, in which:

FIGS. 9 to 18 show a modified form of the assembly of cup, fingers and arm carrying the cup and fingers, in which FIG. 9 is a perspective view with the fingers and cup both open, FIG. 10 is a similar view, but with the fingers omitted and the cup closed, FIGS. 11 and 12 are side elevations of the assembly from opposite sides, FIG. 13 is a partly exploded perspective view showing individual components, FIG. 14 is a more completely exploded view, FIG. 15 is a perspective view showing the operation of the fingers, and FIGS. 16 to 18 show the finger mechanism with the fingers respectively open, closing, and closed, some of the components not relevant to the movement of the fingers being omitted from FIGS. 16 to 18.

DESCRIPTION OF THE PREFERRED EMBODIMENTS

The machine shown in FIGS. 1 to 5*a* of the drawings will firstly be described in more detail, referring to the various sections of which it can be regarded as being composed:

a) Film Handling Mechanisms

The initial film handling mechanisms use techniques already employed with existing vertical, form, fill and seal machines. A reel of film 1 is supported on a horizontal axis by a mandrel (not shown), and means (not shown) are provided to unwind it and brake it as necessary. Adjustment of the lateral position of the reel is required so it can be tracked to be in line with the tubeformer. Date code printing and registration detection, i.e. detection of registration markings which denote the end of each bag and with which the film is pre-printed, take place (this can be by conventional means) and the film then passes through a tubeformer 2.

b) Tubeformer

Figure 2:
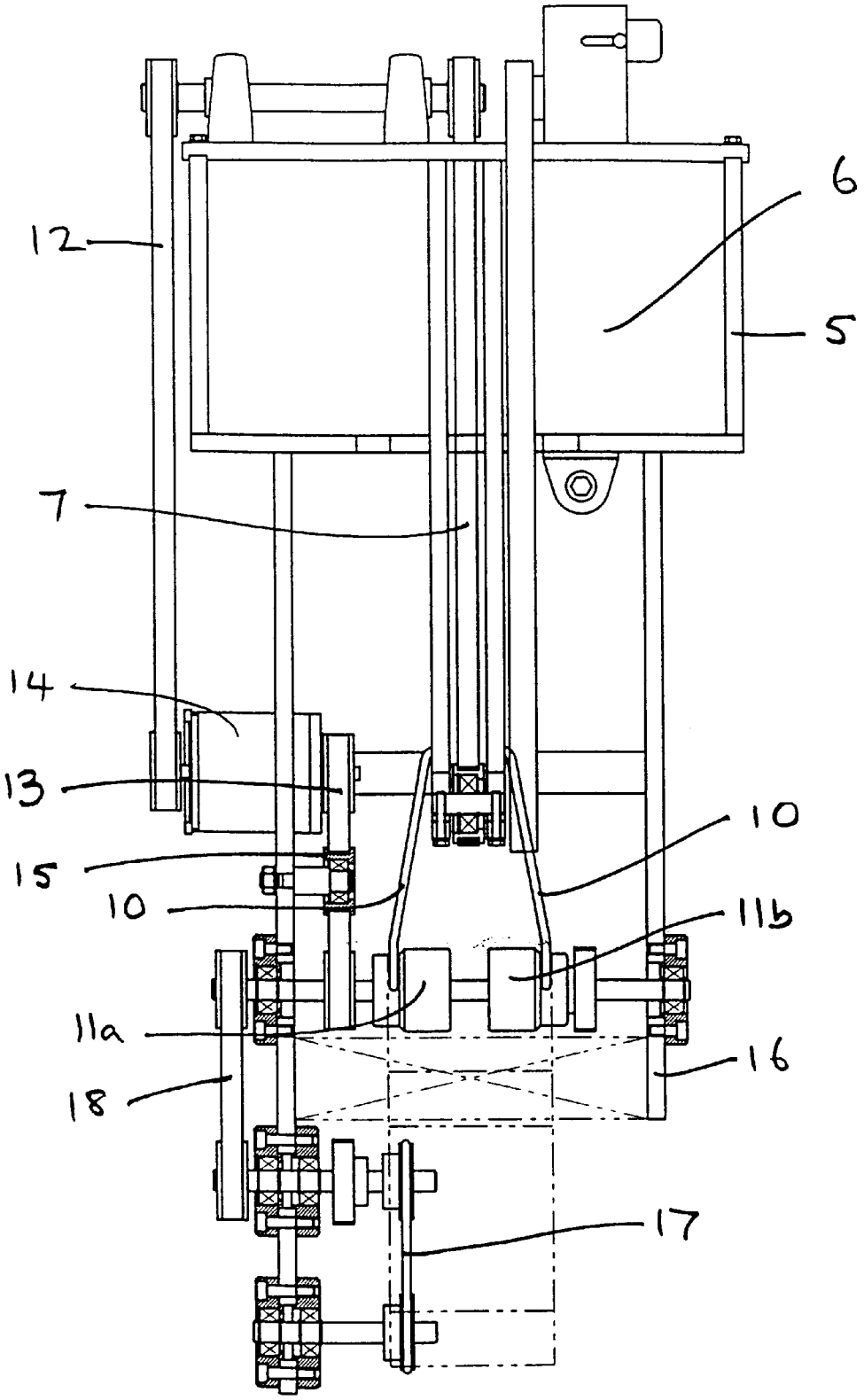
FIG. 2 shows the complete vertical seal assembly used in the machine of FIG. 1.

A conventional tubeformer is used, as applied to current vertical, form, fill and seal machines, to make the film 1 into a tube 3 with overlapping edges 4. FIG. 2 shows a frame 5 which is used to support the tubeformer, and indicates as 6 the location where the tubeformer is mounted. FIG. 2 omits the tubeformer itself.

c) Vertical Sealer and Film Pull Down

Within this film tube 3 is a moving inner belt 7, which contacts the film where its edges overlap. Outside the tube, also at the point where the two edges of film overlap, is an outer moving belt 8, which contacts the film, and a heating block (not shown). Hence both internal and external film contacting surfaces are running at film speed while heat is transmitted to the film to make the longitudinal seal. Since in the embodiment illustrated in FIG. 1 the tube of film moves vertically downwards, this is referred to here as the vertical seal, though it must be understood that other orientations of the tube are possible. It is also to be understood that the illustrated sealer may be replaced by one having stationary sealing elements, for example one in which there is a stationary internal heater and stationary external heater.

Immediately at the bottom of the vertical seal belts 7, 8 are a pair of spreading fingers 10 (see FIG. 2) which are inside the round film and serve to flatten it. Beneath this is a pair of pinch rollers 11 which pull the film from the reel, over the tubeformer and through the vertical sealer. In the view of FIG. 2 one of the pair of pinch rollers is visible, and it can be seen to consist of two roller elements 11*a*, 11*b* each attached to one of the spreading fingers 10. The distance between the two elements is adjustable, so as to enable the distance between the spreading fingers to be adjusted, and this allows for films of different widths. FIG. 2 also shows drive belts 12 and 13 for driving the sealing belts and pinch rollers respectively from a motor 14. The belt 13 passes over a roller 15 offset outwardly to maintain tension in the belt.

d) Knife

A knife (see FIG. 2 for the location 16 of the knife), an embodiment of the knife being described below with reference to FIG. 7, cuts the film, which is now a flat tube, into bag length sections. A rotary knife rotating about a horizontal axis is preferably used, its speed being matched to the film speed. The motions of the vertical seal, pull down rollers and knife are synchronised to the registration marks on the film, so that bag sections cut to the right length are presented to the next handling mechanism, at exactly the right time.

e) Picker

The bag section must remain under control immediately after it is cut and so a pair of opposed vertically moving retaining belts 17 (see FIG. 2), driven via a drive belt 18, support it lightly. The transition from the vertical motion to the horizontal motion, necessary for presentation to the carousel, is performed by a picker 20 (see FIG. 3). This consists of a plurality of pairs of parallel horizontally moving belts 21 (three such pairs are shown) with protrusions 22 which grip the bag sections, the righthand edges of which travel down a guide plate 23, and cause them to move horizontally. The motion of these belts is such that each bag section is quickly released from the vertical retaining belts 17 and its speed is matched to the carousel when it is presented to it. The belts 21 pass round a first set of pulleys 24 on a first pair of shafts 25, driven by a motor 25*a*, and a second set of pulleys 26 mounted on a second pair of shafts 27. The second shafts 27 are driven by a motor 27*a* and the pulleys 26 are fixedly secured thereto. The pulleys 24 are mounted for freewheeling motion on the shafts 25, which is necessary because the shafts 25 also carry additional further pulleys fixedly secured thereto (not shown in FIG. 3) whose function is explained below and which need to be able to travel at a different speed to the pulleys 24.

f) Bottom Sealer

The technology used to form a bottom seal on each of the bag sections is well known within the industry as applied to fin sealing. As shown in FIGS. 4*a* and 4*b*, the bottom sealer 30 comprises a pair of disc shaped, heated rollers 31, 32 which rotate in a horizontal plane and pinch the film between them. The pinching effect is achieved by having one of the rollers (the righthand one 32 in FIGS. 4*a* and 4*b*) spring-loaded towards the other by washer-type springs 40, for example Belleville washers, which are inserted on the proximal side of locknuts 41 threadedly received on rods 42 which hold roller mountings 43 together. The other roller, 31, has a timing belt 33 mounted thereon to transmit drive thereto from a motor 44. The bag is transported by means of a pair of lower belts 34, 35 each of which passes around a respective pair of pulleys 36, 37 and which are located immediately above the sealing rollers, and by another pair of belts 38, 39 (see FIG. 3) which retain the top of the bag.

g) Bag Opener

Figure 3:
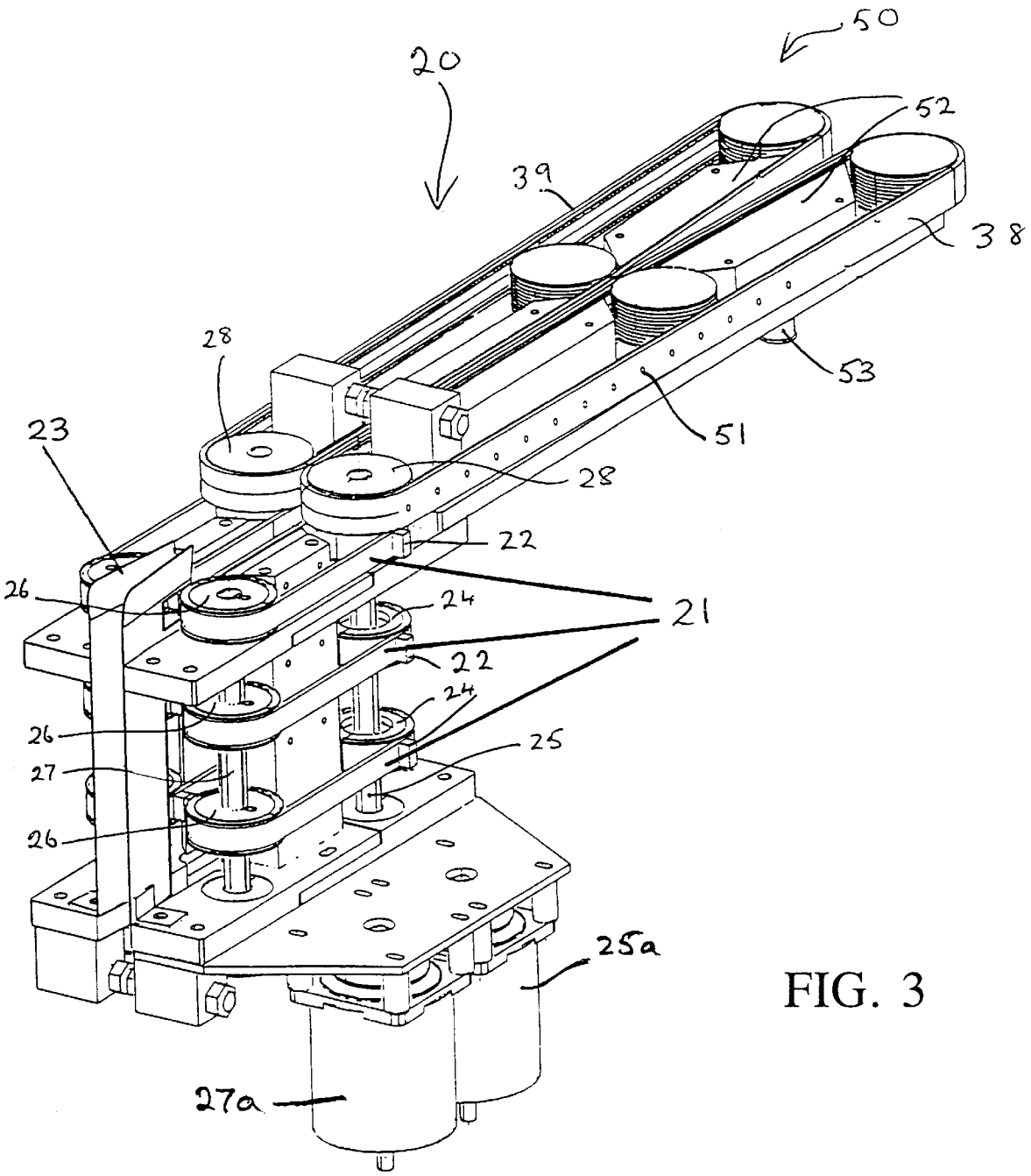
FIG. 3 shows a picker for the use in the machine. The embodiment of picker shown in FIG. 3 differs from that shown diagrammatically in FIG. 1.
Figure 4A:
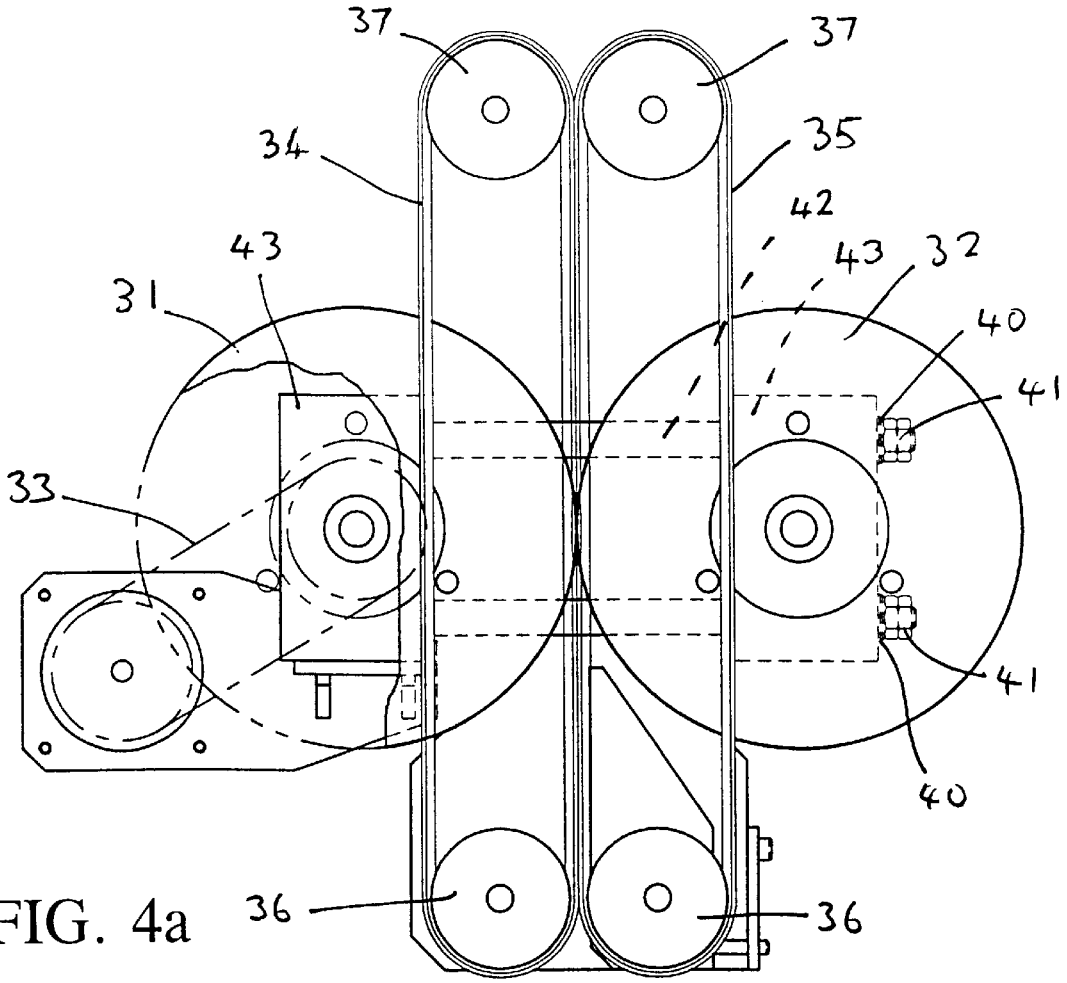
FIGS. 4*a* and 4*b* are a plan view and an elevational view (partly sectional) showing in detail a bottom sealer for use in the machine, the design being similar to the top sealer, the sealer being shown only diagrammatically in FIG. 1.
Figure 4B:
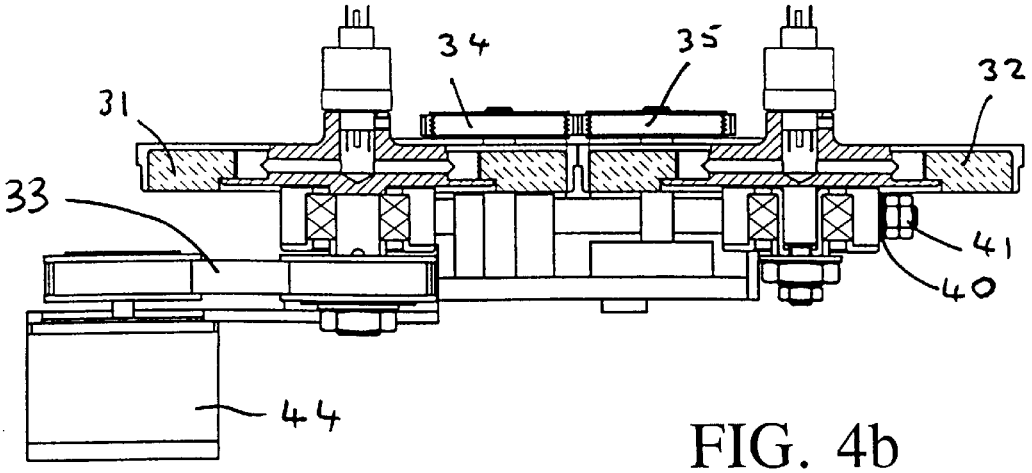

The bag opener 50 can be seen in FIG. 3. Immediately after the bottom sealer 30, the open-topped bag thus formed continues to be retained by the lower belts 34, 35. The upper belts 38, 39 come apart gradually. These belts have a row of holes 51 spaced along their length. A slight vacuum is drawn from behind them by vacuum chambers 52 to which vacuum is supplied from a vacuum source (not shown) via a duct 53 and so the top of the bag opens.

h) Carousel

Figure 1:
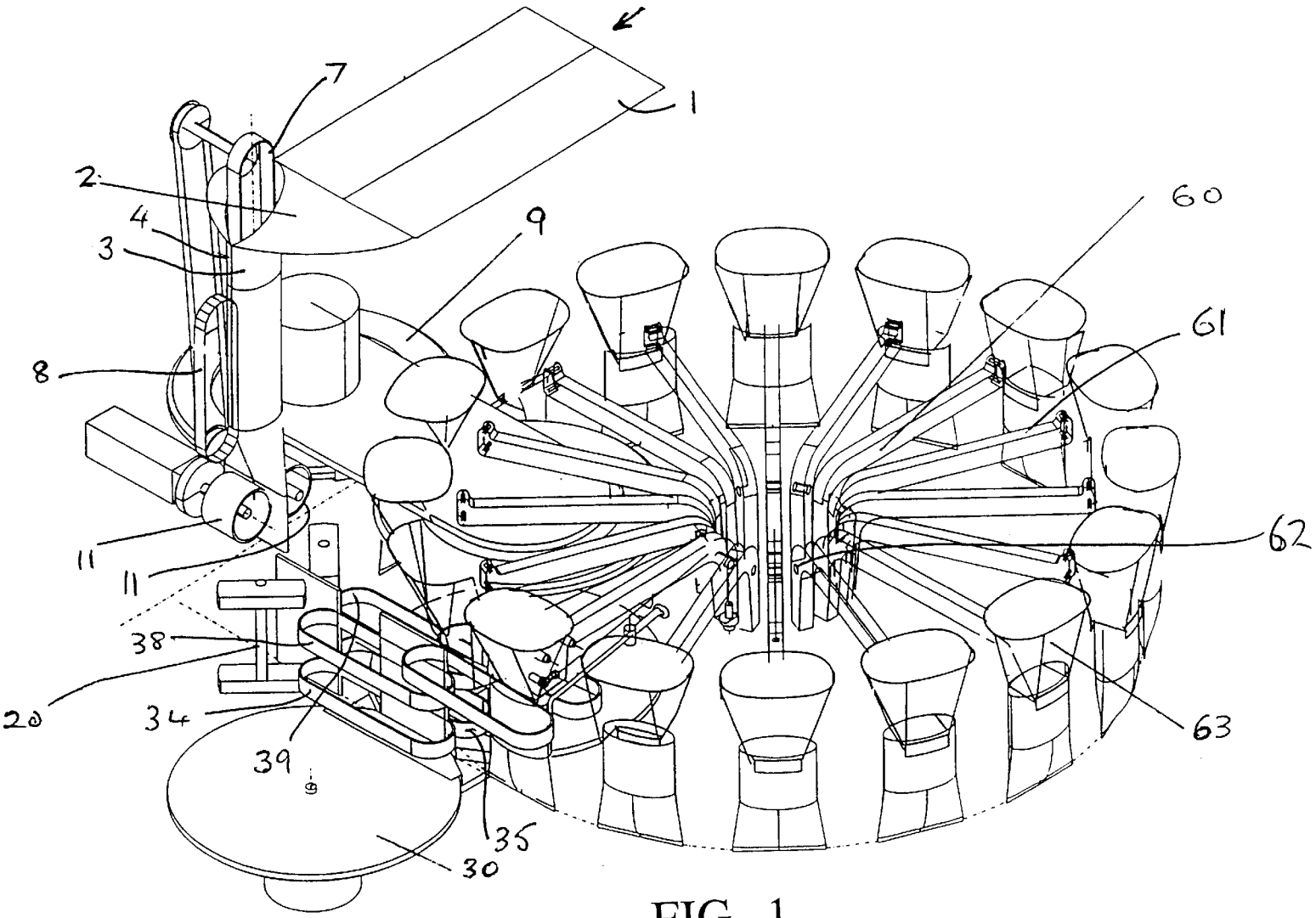
FIG. 1 shows the general arrangement, in diagrammatic form, of an embodiment of a machine according to the invention.
Figure 5A:
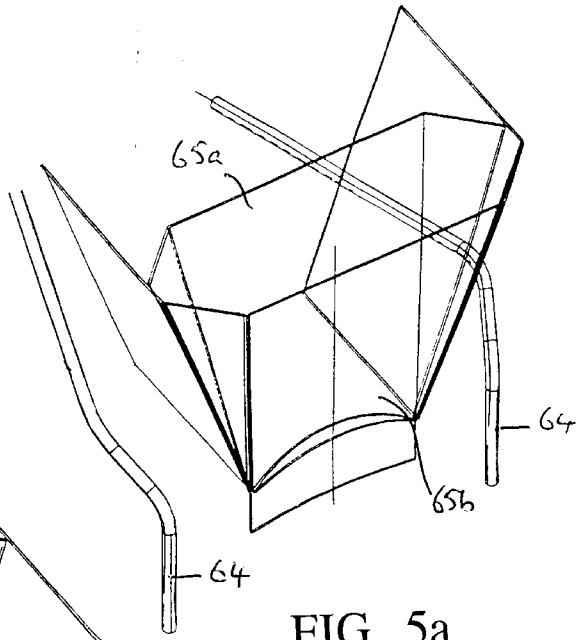
FIG. 5*a* shows a detail of FIG. 5, with the cup in its closed position.
Figure 5:
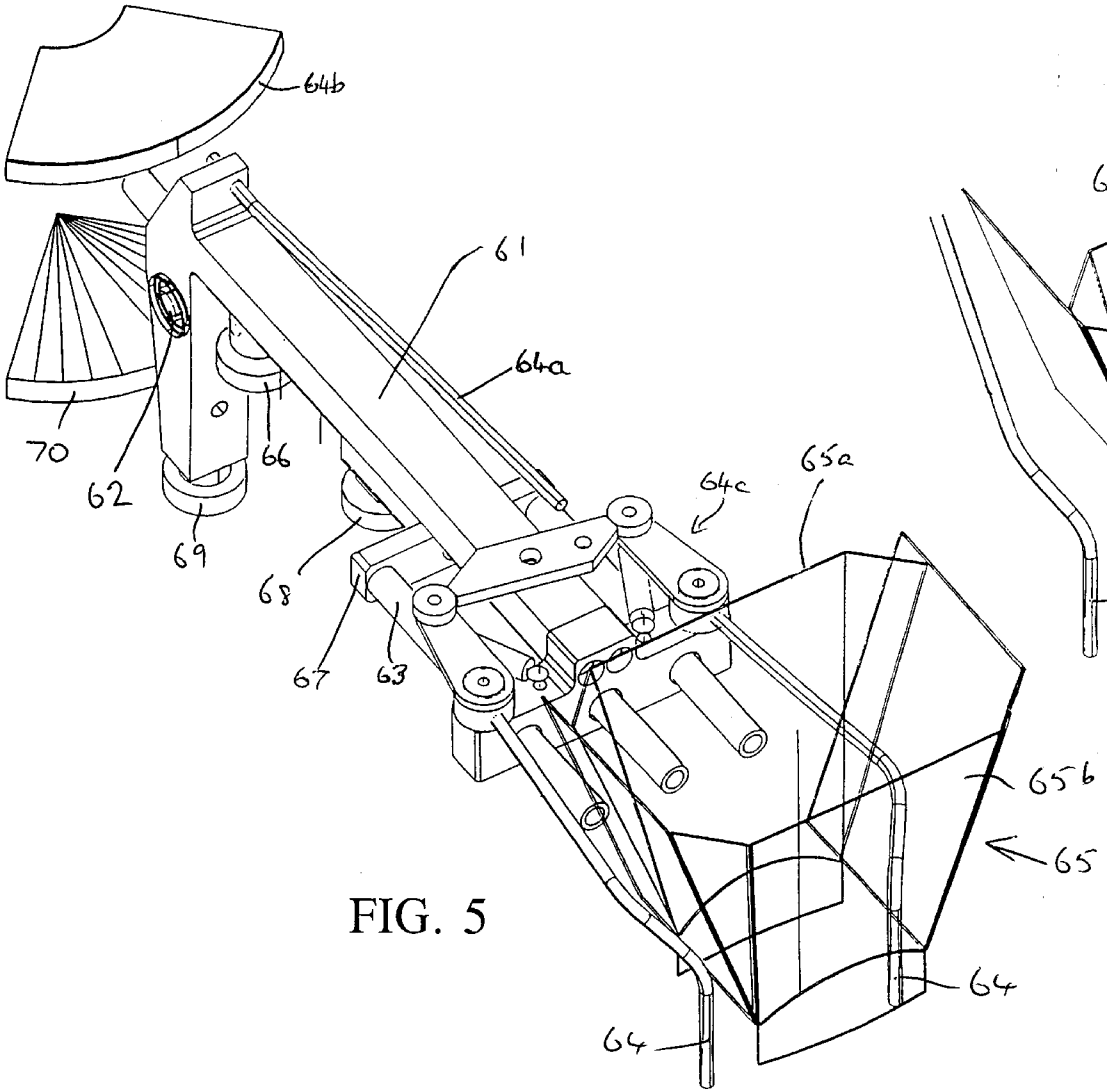
FIG. 5 shows a cup and finger mechanism, with the cup in its open position.

The carousel 60 and components thereof are shown in FIGS. 1 and 5. It consists of a rotating hub (not shown) with a number of radial arms 61 fixed to it. These arms hinge vertically about hinge points 62 so that the mechanisms on their outer ends can be inserted into the bags. Each mechanism comprises a pair of fingers 64 and a cup 65. The fingers enter the bag and hold the bag longitudinally (tangential to the carousel) so that the top of it is kept under control as it is released from the opener. The cup 65 comprises an inner cup half 65*a* and an outer cup half 65*b* which are movable radially with respect to one another between an open position (FIG. 5) and a closed position (FIG. 5*a*). After these have been inserted into the bag with the cup in the closed position of FIG. 5*a*, they are separated radially, into the position in FIG. 5, so that they form a chute at the top of the bag into which the product can be dropped. The fingers 64 are sprung loaded so they come together as the cup halves open.

The way in which movement of the cup halves, the cup as a whole, and the fingers, is achieved, can be understood from FIGS. 5 and 5*a*. The inner cup half 65*a* is connected, by means shown only in part, to a cam follower 66, and the outer cup half 65*b* is connected by rods 63 and a yoke 67 to a cam follower 68. Each of cams 66 and 68 is adapted to engage a respective stationary cam as the arms rotate about the carousel. The cup as a whole, with its arm 61, is pivoted upwards and downwards about the pivot point 62 by means of a cam follower 69 which engages a further stationary cam 70. Movement of the fingers 64 towards and away from one another is controlled by a rod 64*a*, the radially inner end of which is arranged to contact a stationary disc 64*b* and the radially outer end of which is connected to a pivot arm assembly 64*c* which carries the fingers 64.

i) Bag Transport Round the Carousel

After the bag has left the bottom sealer and the opener, the top of it is retained by the fingers and cups. The bottom of the bag is retained by a pair of horizontally moving opposed belts or belt arrays (not shown), similar to those used for letter transporters in automatic sorting systems. The two belts or belt arrays follow concentric circular paths and carry the bottom of the bag between them.

j) Product drop

Product is dropped from a conventional multihead weigher (not shown) with a fixed chute at its lower outfeed end. As the carousel rotates, the bags with their open chutes pass under the fixed weigher chute. The dropping of the product is synchronised to the passage of the bags underneath.

k) Stripping

Immediately after it has been discharged, the product may have a tendency to project above the top of the bag into the cup area. In the first instance, the product will be compacted by jostling the bag as it proceeds round the carousel. Finally, a plunger (not shown) may be used to force any remaining product below the level where the top seal is formed.

Top Sealer

Immediately before the top sealer 9, which can be of conventional construction, the cup halves are partially closed and the fingers and cup are withdrawn from the bag. The top of the bag is retained by belts as it is introduced to the top sealer, which operates on the same principle as the bottom sealer. After this the bag is discharged from the machine.

Figure 6:
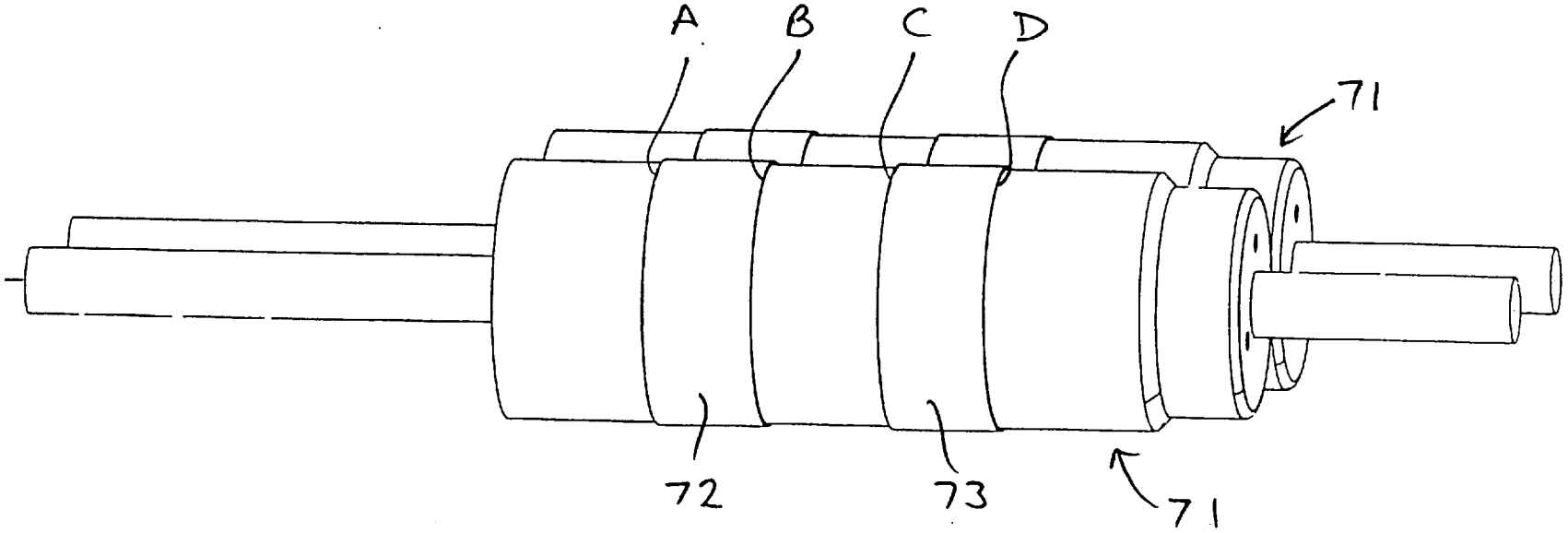
FIG. 6 is a perspective view of a modified form of pinch rollers.

FIG. 6 shows a modified design for the pinch rollers, replacing the rollers 11. Each of the rollers 71 shown therein comprises a pair of outwardly extending land sections 72, 73 which run axially between locations A and B, and C and D, respectively. The axial distance between A and D is less than the width of a bag, typically 20 mm less, so that the tube of film is not compressed at its edges and is therefore not creased. This is desirable both operationally and from the point of view of appearance. The recess BC defined between the lands is broader than the vertical seal, so that the film does not contact the pinch rollers in this area, which at the stage when the film passes between the pinch rollers, is still hot. This minimises the risk of the front and rear parts of the film being caused to adhere to one another.

Figure 7:
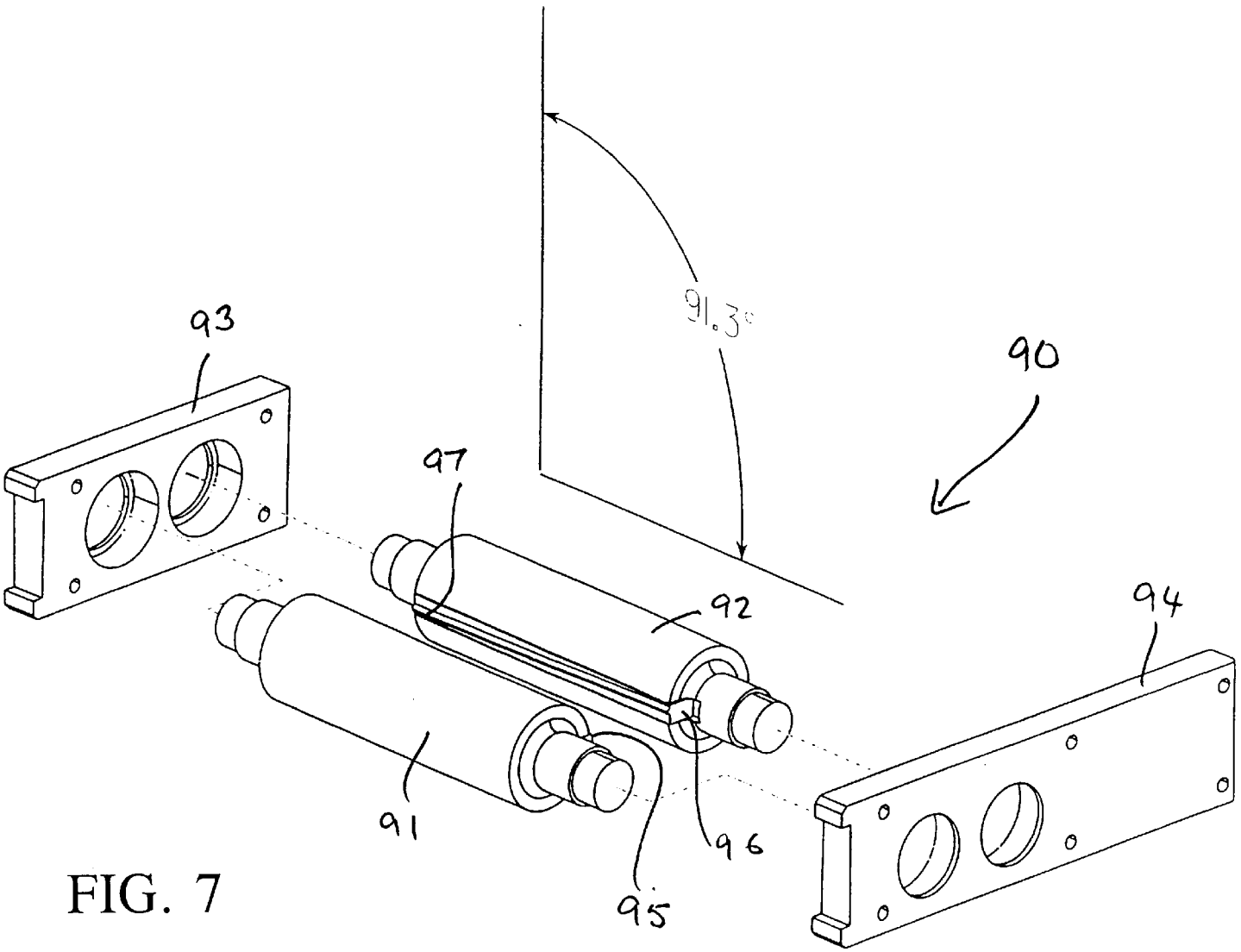
FIG. 7 is an exploded perspective view of a preferred design of knife.

FIG. 7 shows a preferred construction of knife 90 for installation at location 16 (see FIG. 2). This is a crush knife and comprises a pair of cylinders 91 and 92 mounted for synchronous rotation in opposite senses in end blocks 93, 94. The cylinder 91 has an anvil 95 the surface of which protrudes slightly from the remainder of the cylinder surface and which extends along the length of the cylinder. The cylinder 92 has a cutting member 96, the cutting edge 97 of which runs at a small acute angle $\alpha$ to the axis of rotation of the cylinder 92. This angle $\alpha$ may, for example, be from 1° to 2°, and in an actual embodiment an angle of 1.3° was found to be suitable. The cylinder 92 is arranged so that its axis of rotation is at an angle of $(90+\alpha)°$ to the path of the film, as indicated in FIG. 7, so that the cutting edge 97 is at 90° to the film path. The cylinder 91 has its axis of rotation parallel to that of cylinder 92.

In use, the cutting member exerts a cutting force on the film at only a single point (more precisely, a single very small region) at any one moment in time, and this point or region travels rapidly across the width of the film as the cylinder rotates. This gives a very high cutting force and a correspondingly effective cutting action.

Figure 8:
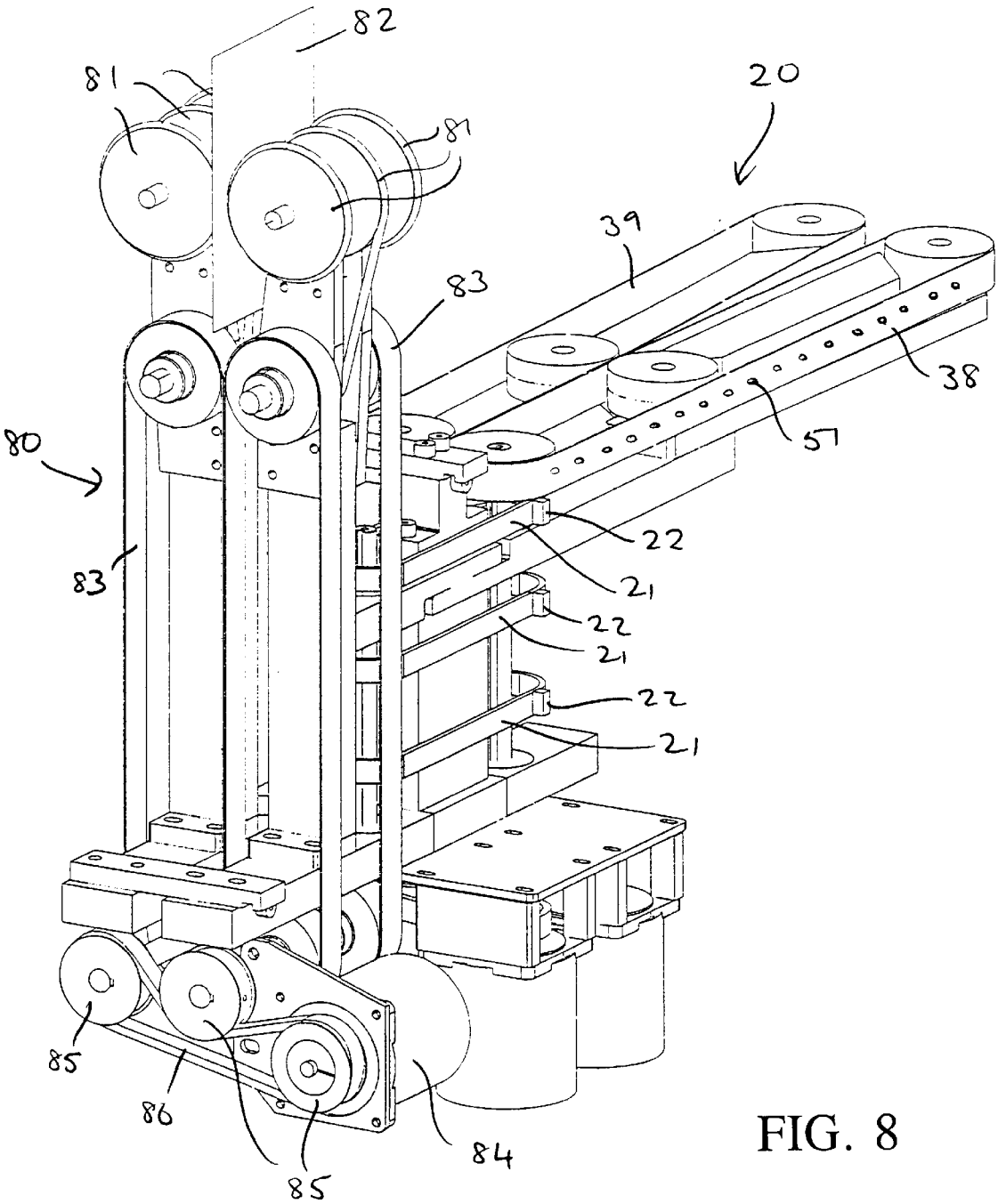
FIG. 8 is a perspective view of a modified form of picker mechanism, incorporating transit belts upstream of the picker belts.

FIG. 8 shows a modified picker mechanism, in which to the picker 20 shown in FIG. 3 has been added a transit assembly 80. This comprises guide rollers 81 which are situated immediately below the knife and which run at the same linear speed as the pinch rollers. The film, a portion of which is denoted in FIG. 8 by numeral 82, is held simultaneously by the guide rollers and the pinch rollers while it is being cut by the knife. Immediately below the guide rollers 81 are two pairs of transit belts 83 which are driven at a higher linear speed than the guide rollers 81 by a motor 84, pulleys 85 and a drive belt 86. The guide rollers can, if desired, be fitted with roller clutches so that they run faster than their driven speed when the bag is being pulled by the transit belts. Since the transit belts are running faster than the vertical speed of the bags as they are cut, a vertical gap is generated between successive bags, so that they can be removed horizontally by the picker without interfering with one another.

The modified arm assembly shown in FIGS. 9 to 18 will now be described. This comprises an arm 100 pivotal about a horizontal axis passing through a pivot point 101. The arm is L-shaped, with a generally vertical portion 100*a* which carries an arm-lifting cam follower 102 at its lower end, and a generally horizontal portion 100*b*. The cam follower 102 is arranged to engage, over a given segment of the rotation of the assembly, a lift cam 103 (see FIG. 17). A double-armed lever 104 is pivotally connected to the arm 100 intermediate the ends of the arm. The upper end of lever 104 is connected by a pair of pivotal links 105 to an upstanding portion of a cross-member 106 which, together with a pair of parallel rods 107 forms a first yoke 108. An inner cup half 109 is fixedly connected to the distal end of the rods 107. The lower end of lever 104 is connected by a pair of pivotal links 110 to a downwardly projecting portion of a cross-member 112 which, together with a pair of parallel rods 113 form a second yoke 114. An outer cup half 115 is fixedly connected to the distal ends of the rods 113.

The arm 100 has a guide plate 116 at its radially outer end. This has a pair of openings 117 through which the rods 107 pass in slidable fashion, and a pair of openings 118 through which the rods 113 pass in slidable fashion. A shaft 119 is secured to the cross-member 112 and extends from it in a direction away from cup-half 115. The shaft 119 carries a cup-controlling cam follower 120 on its underside which is engageable by a cup cam 121. The cam follower 120 is biassed in a radially inward direction towards the cup cam 121 by a compression spring 122 (see FIGS. 11 and 14).

Figure 15:
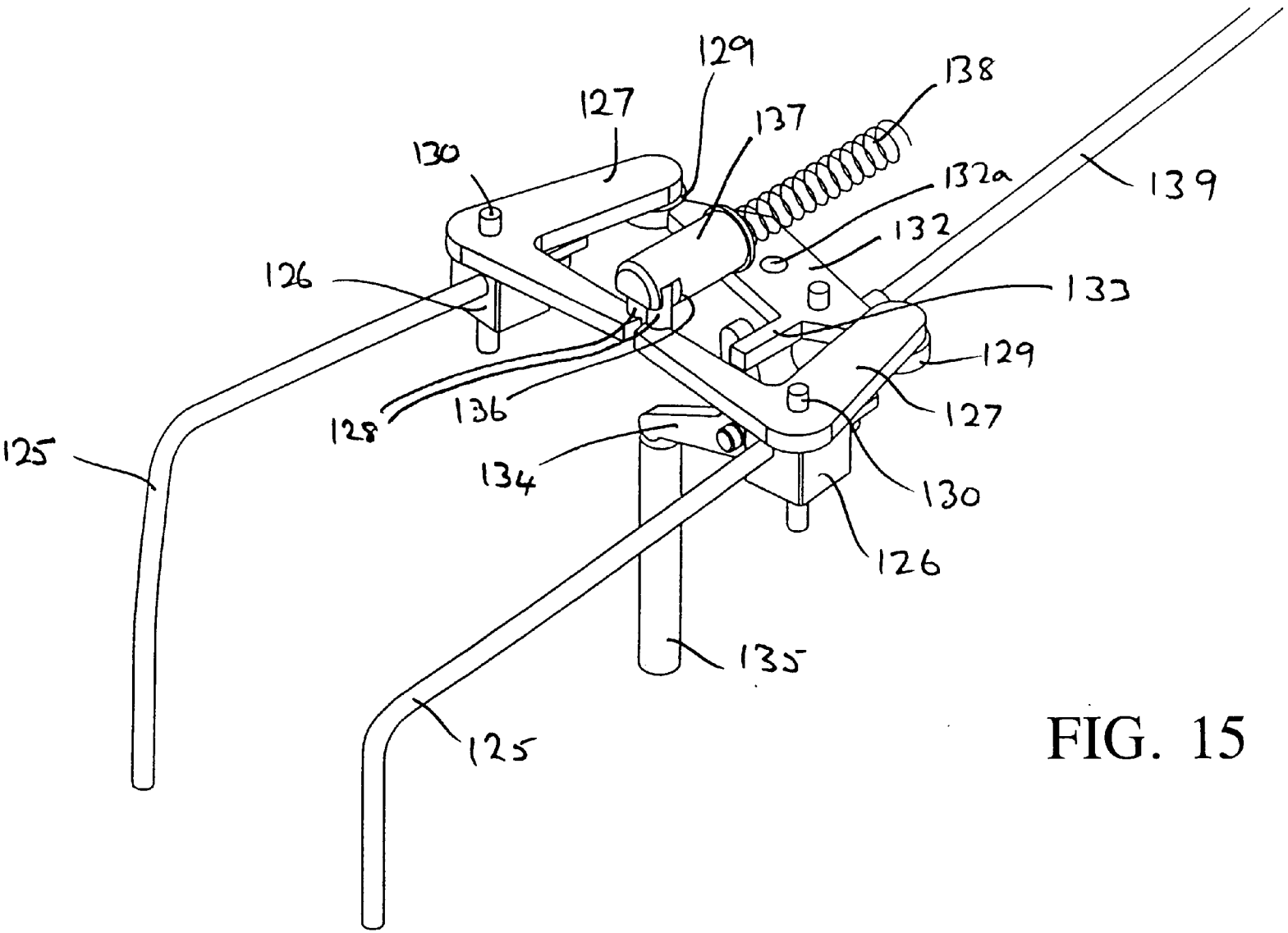

Referring particularly to FIG. 15, the arm assembly has a pair of fingers 125 each of which extends radially outward from a block 126 on the underside of a respective crank arm 127. At its inner end each crank arm carries an upstanding pin 128, and at its opposite end each crank arm carries beneath it a cam follower 129. Intermediate its ends, each crank arm has a pivot pin 130 by means of which the crank arms are mounted, for pivotal movement about generally vertical axes, between projections 131 extending from the guide plate 116 (see FIG. 13). A member 132, referred to herein as a load cam, is mounted on a downwardly extending pin 132*a* (the upper end of the pin is visible in FIG. 15), received in an opening 132*b* in the upper surface of arm portion 100*b* (see FIG. 13), for pivotal movement about a generally vertical axis. A lug 133 extends from the radially outer edge of the load cam 132 and is positioned to be engaged by one arm of an L-shaped trigger 134 which is pivotally connected to the block 126 for movement about a generally horizontal axis. FIG. 15 also shows a striker post 135 which is fixedly mounted on the frame of the carousel (i.e. it does not rotate with the carousel) and which is arranged so that in one position of the arm in its rotation with the carousel, for which see below, the lower arm of the L-shaped trigger 134 strikes it.

Figure 9:
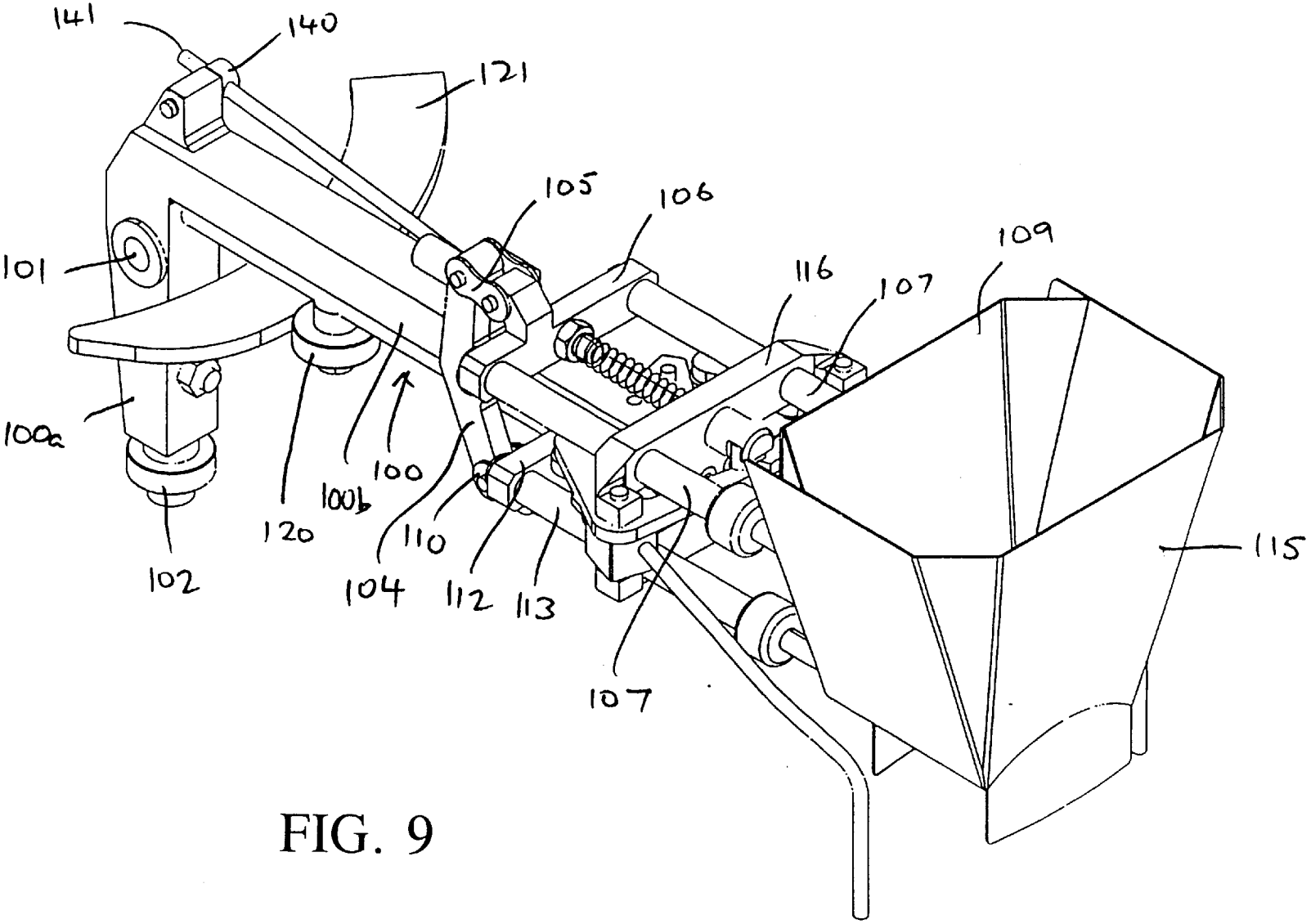
Figure 10:
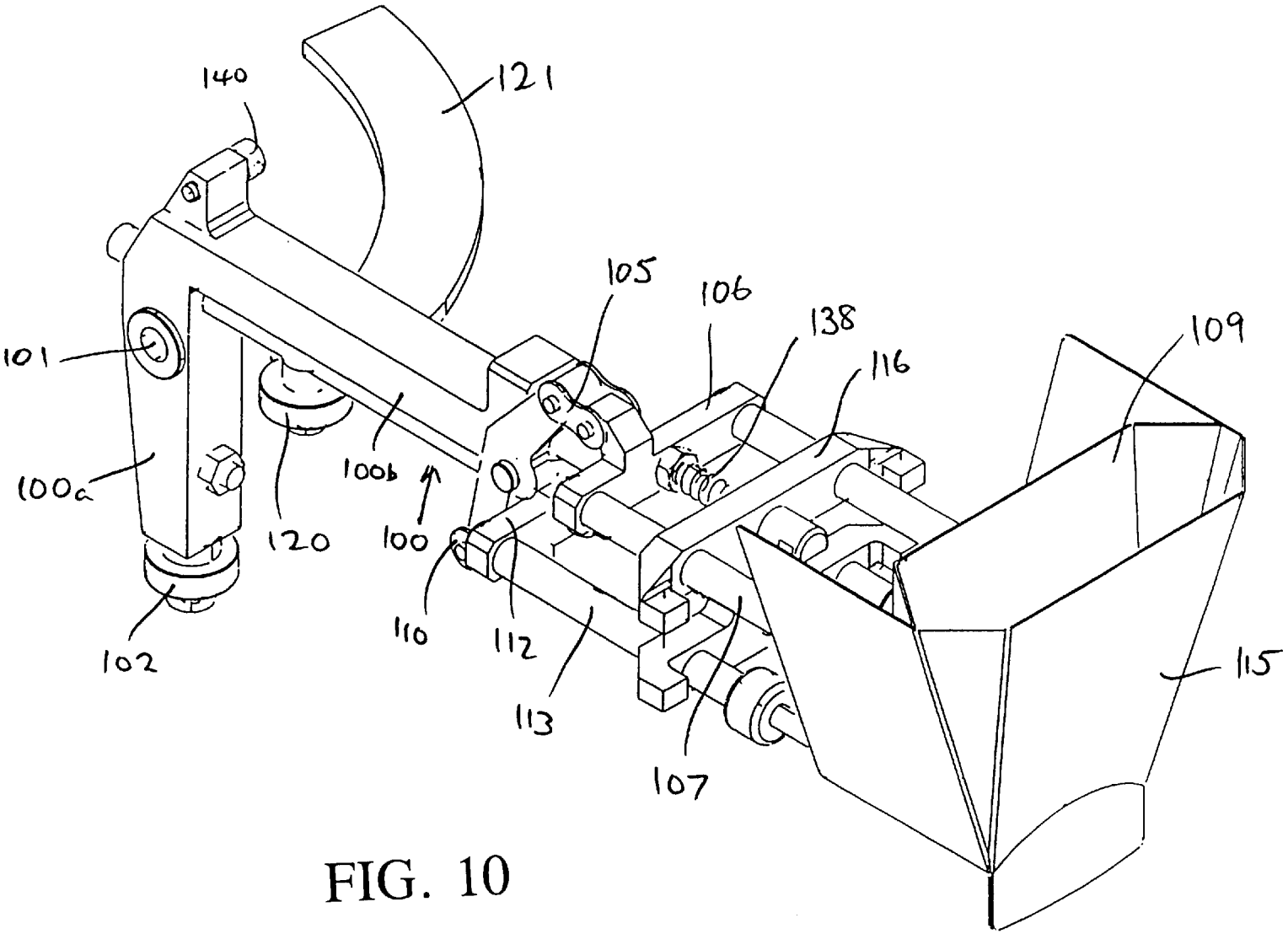
Figure 11:
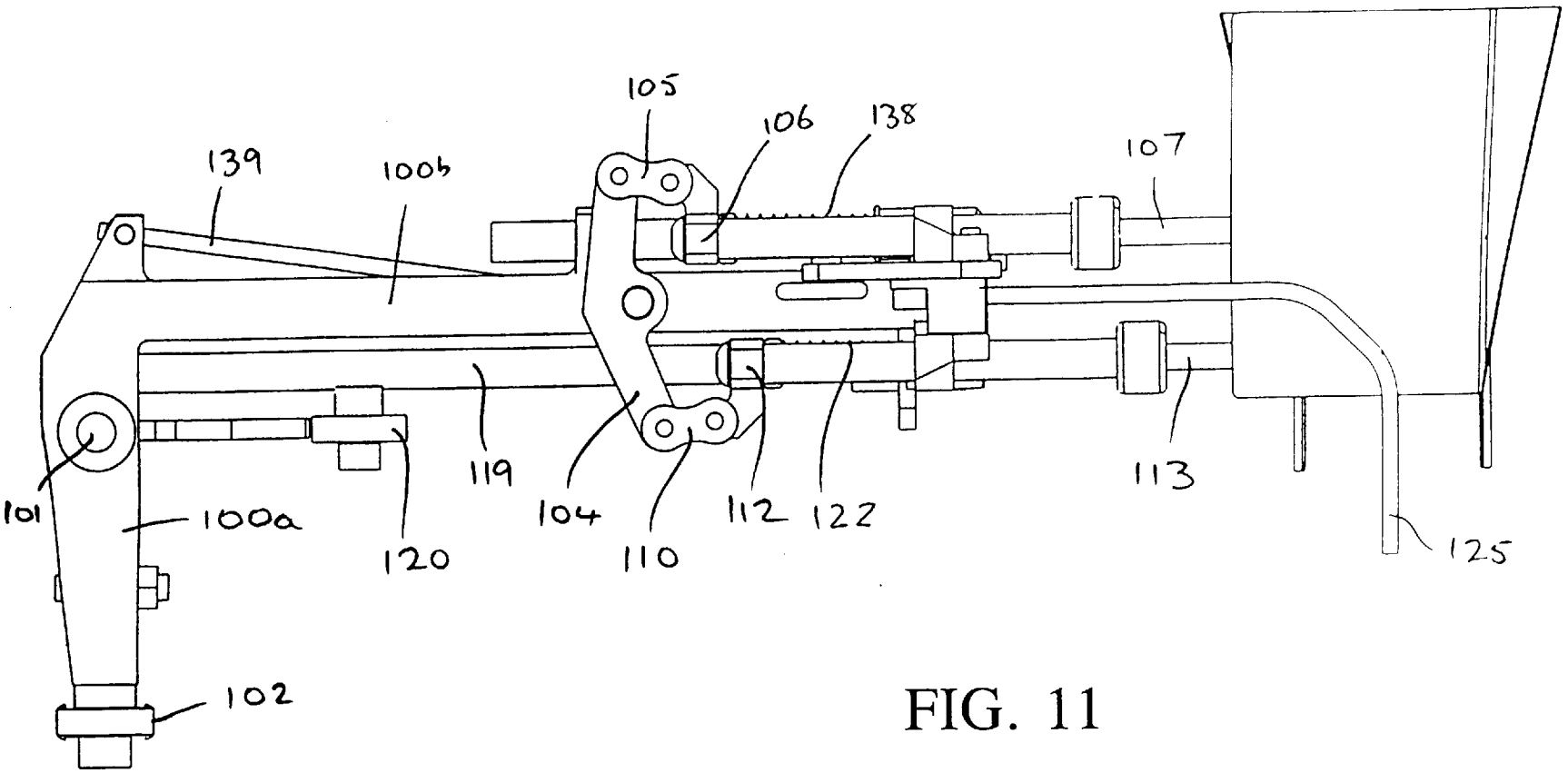
Figure 12:
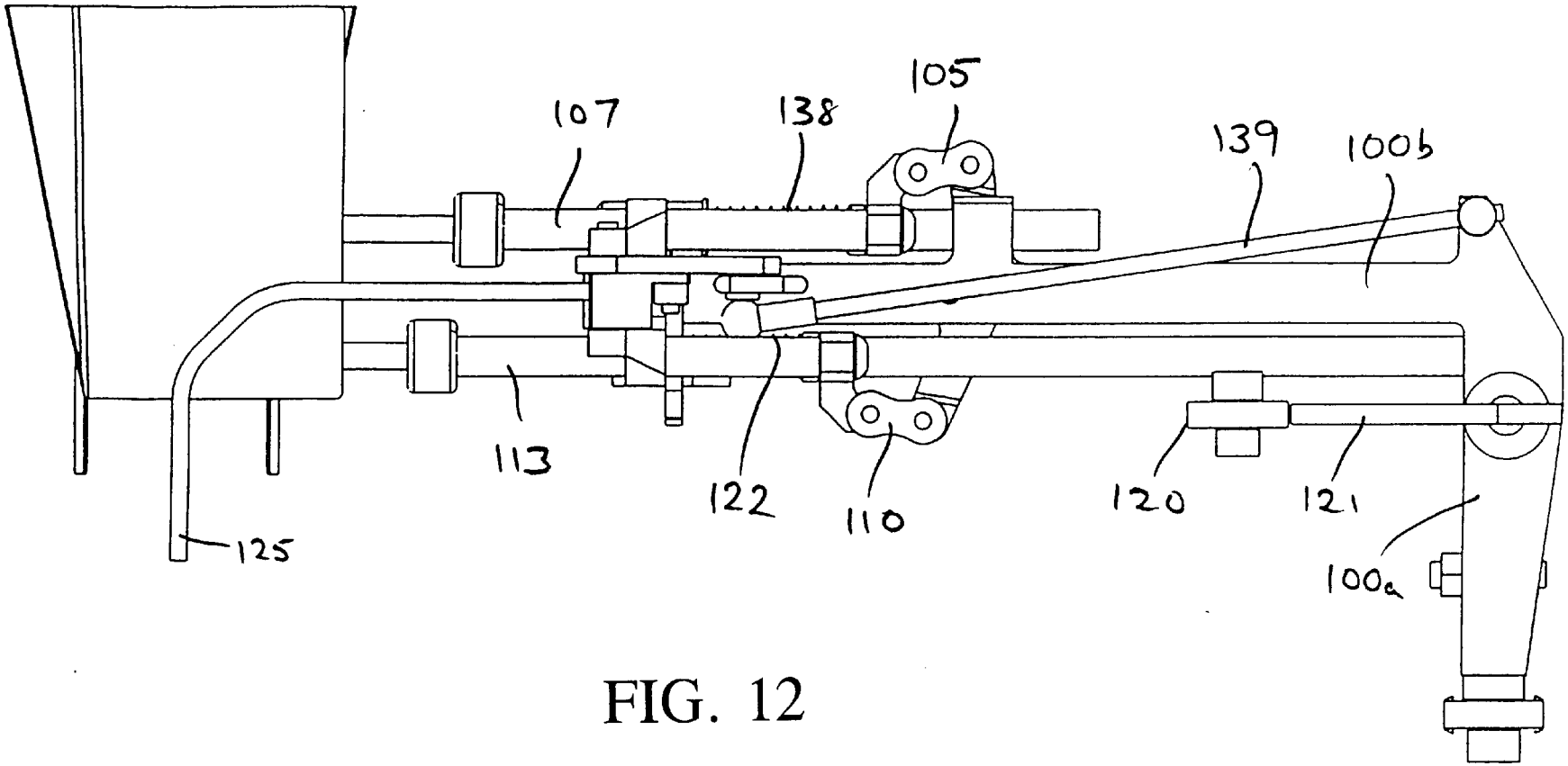
Figure 13:
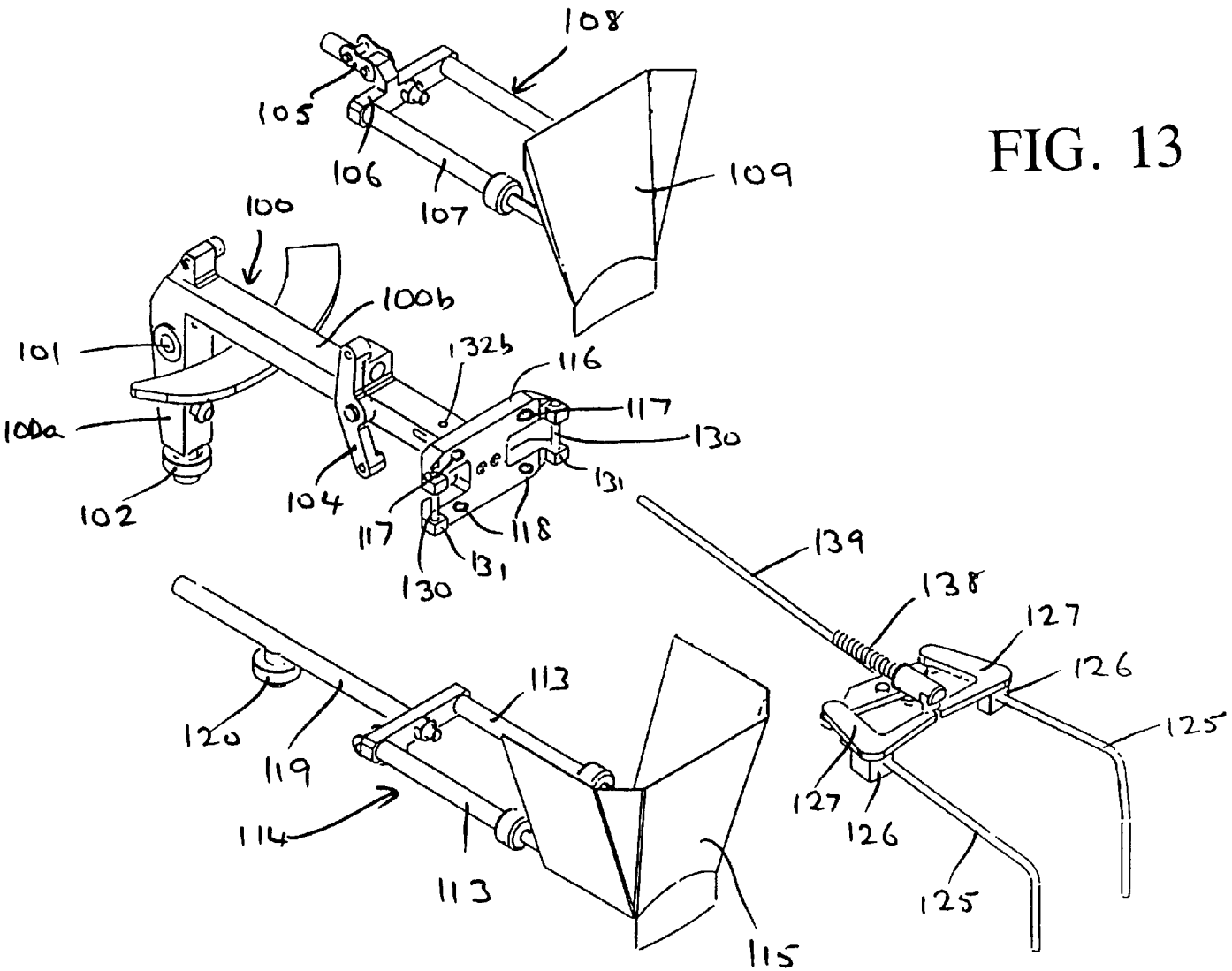
Figure 14:
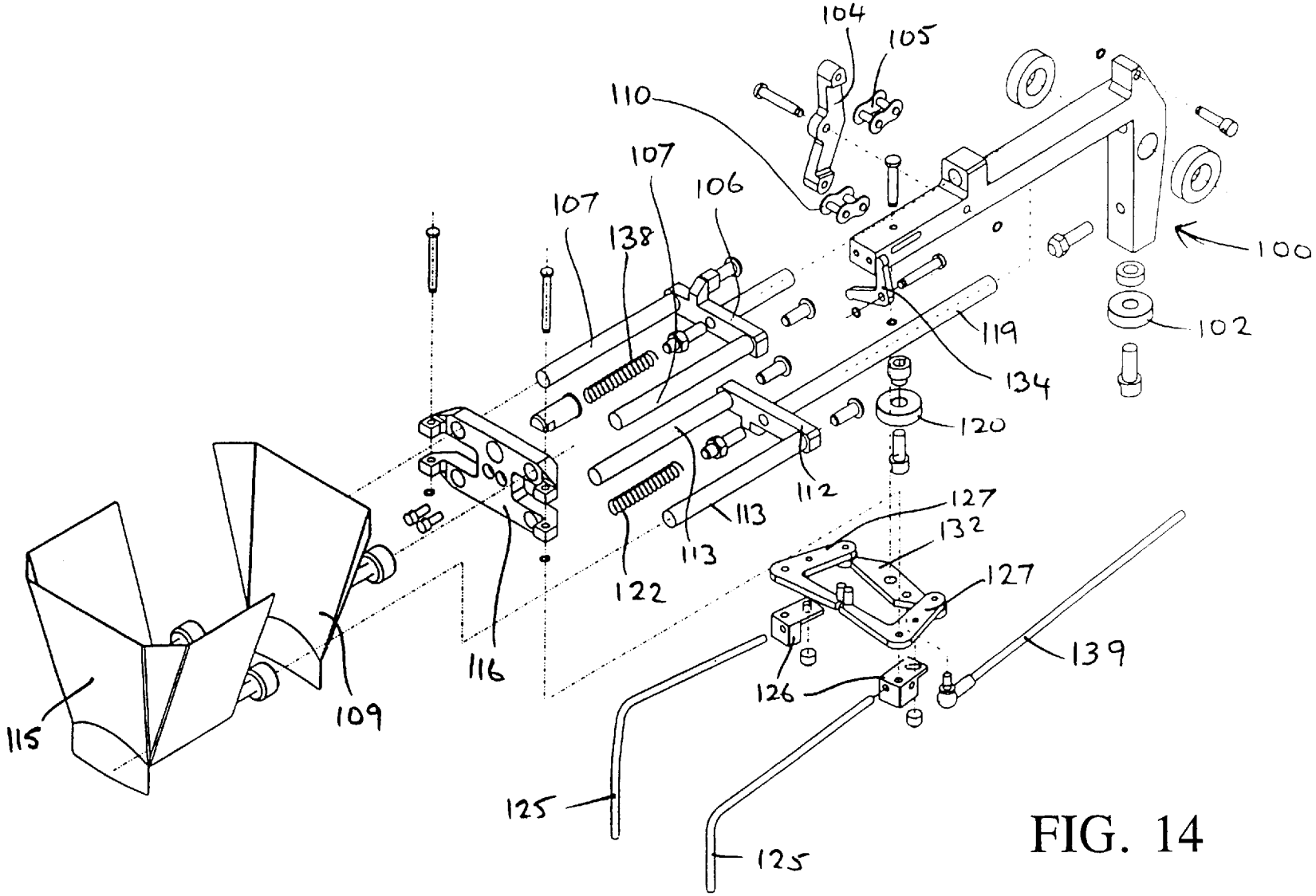

The upper ends of the pins 128 are held in a slot 136 formed in the underside of a plunger 137 which is spring biassed in a radially outward direction by a compression spring 138 whose other end bears against the cross-member 106 (see, for example, FIG. 9). It should be noted that when the cup is open the distance between the cross-member 106 and the plunger 137 is much greater than when the cup is closed. The size of the spring, and its spring constant are chosen so that in the former condition it exerts very little force on the plunger, whereas in the latter condition it exerts a substantial force. This means that when the cup is open the fingers are urged apart only lightly and are not able to open the bag sideways and thus flatten it. This is clearly advantageous, in that the object of the open cup is to enable product to be introduced into the bag. A resetting rod 139 is connected at its radially outer end by a ball joint to the load cam 132 and is slidably guided adjacent its other end by a guide member 140 connected to the arm 100 for pivotal movement about a horizontal axis with respect thereto. The radially inner end 141 of the resetting rod is arranged to bear over a given segment of the rotation of the assembly against a cam disc 142 (see FIG. 17).

Figure 18:
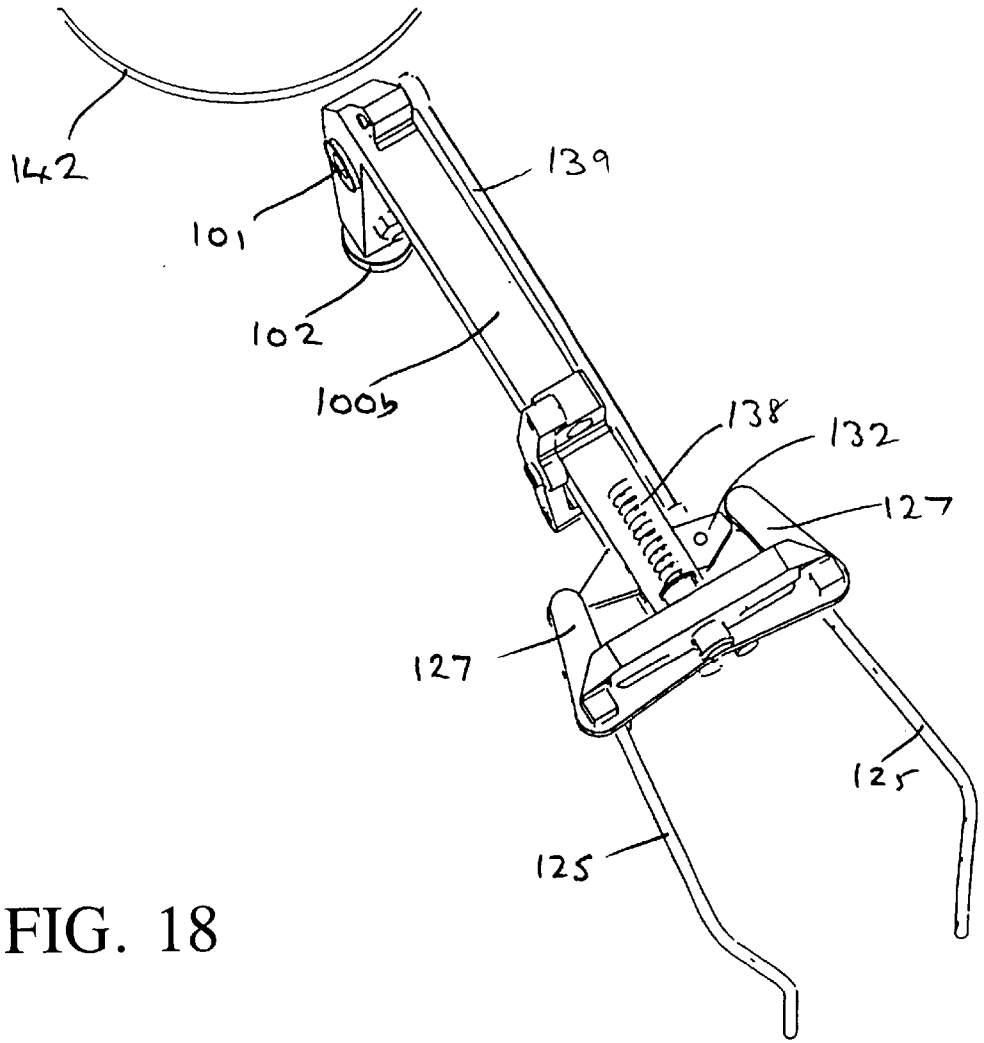

A description will now be given of the operation of the assembly of FIGS. 9 to 18, in relation to its rotation with the carousel through 360°. The sequence of events which takes place is as follows (it must be understood that the angles are approximate, and can vary substantially from machine to machine):

0°: The arm 101, which is at an intermediate height, starts to drop into the bag which is being held open by the vacuum belts, the fingers being closed as shown in FIG. 18. Lowering of the arm is under the control of engagement between the cam 103 and the cam follower 102. The cup is in a closed condition.

Figure 16:
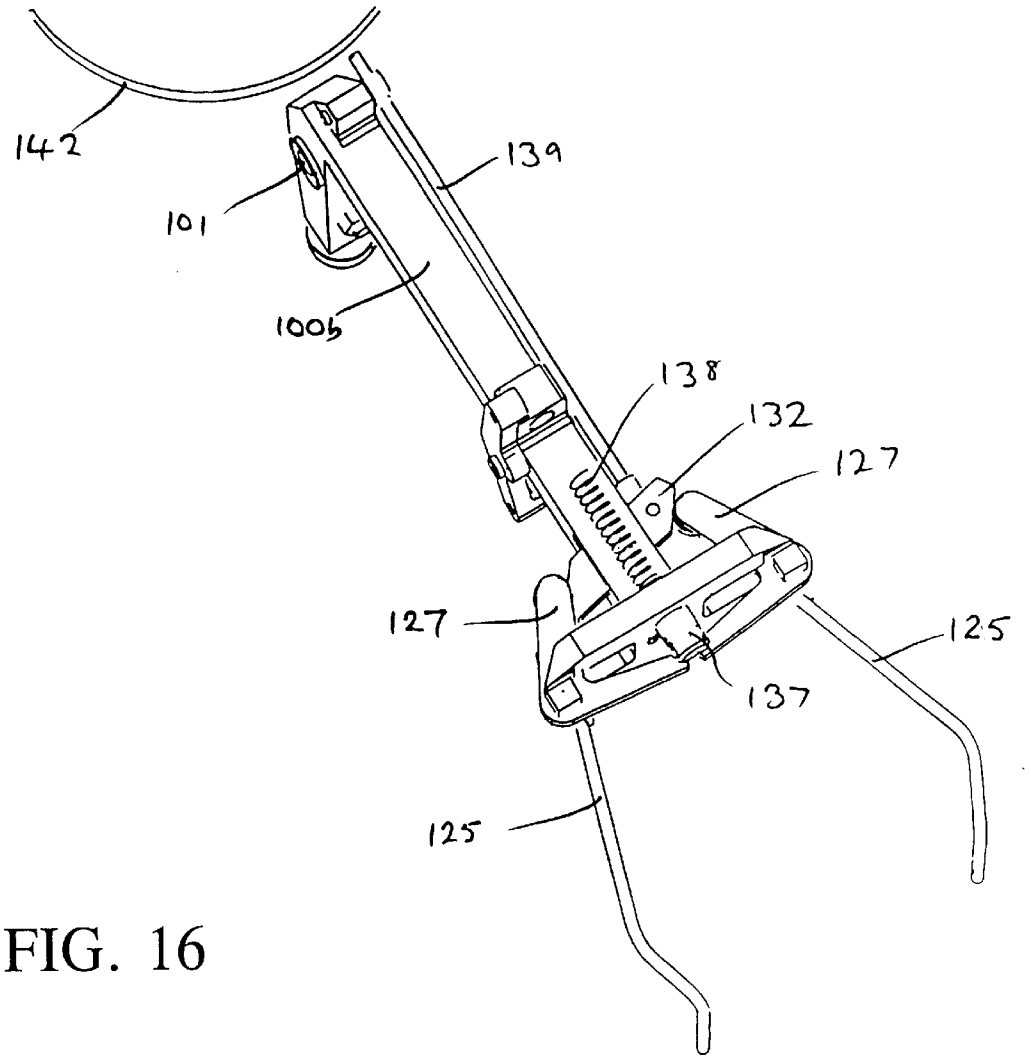

5°: Continued lowering of the arm causes the trigger 134 to strike the post 135 (see FIG. 15, where contact has just been made), which then causes the trigger to rotate. This in turn produces rotation of the load cam 132, via its lug 133. The load cam is no longer in a position to keep the cam followers 129 apart, and the crank arms 127 therefore rotate under the force applied to their pins 128 by the spring 138, so moving the fingers 125 to their open position (FIG. 16). Shortly after this position the arm becomes fully lowered (horizontal).

10°: The cup-controlling cam follower 120 engages the cam 121 (FIG. 10) and starts to move the outer cup half 115 radially outwardly. By virtue of the double-armed lever 104, the inner cup half 109 simultaneously starts to move radially inwardly. Thus, the cup begins to open.

20°: The cup is now fully open (FIG. 9).

45°–90°: Product is introduced into the bag through the open cup as the arm rotates through this range.

180°: The radius of the cam 121 begins to reduce, causing the outer cup half 115 to begin to move radially inwards, and, by virtue of the double armed lever 104, causing the inner cup half 109 simultaneously to begin to move radially outwards. Thus, the cup begins to close.

200°: The cup is fully closed and the bag is held by the fingers. The arm starts to lift as a result of re-engagement of the cam follower 102 with the cam 103.

230°: The arm reaches an intermediate height, ready to transfer the bags to the top seal belts.

Figure 17:
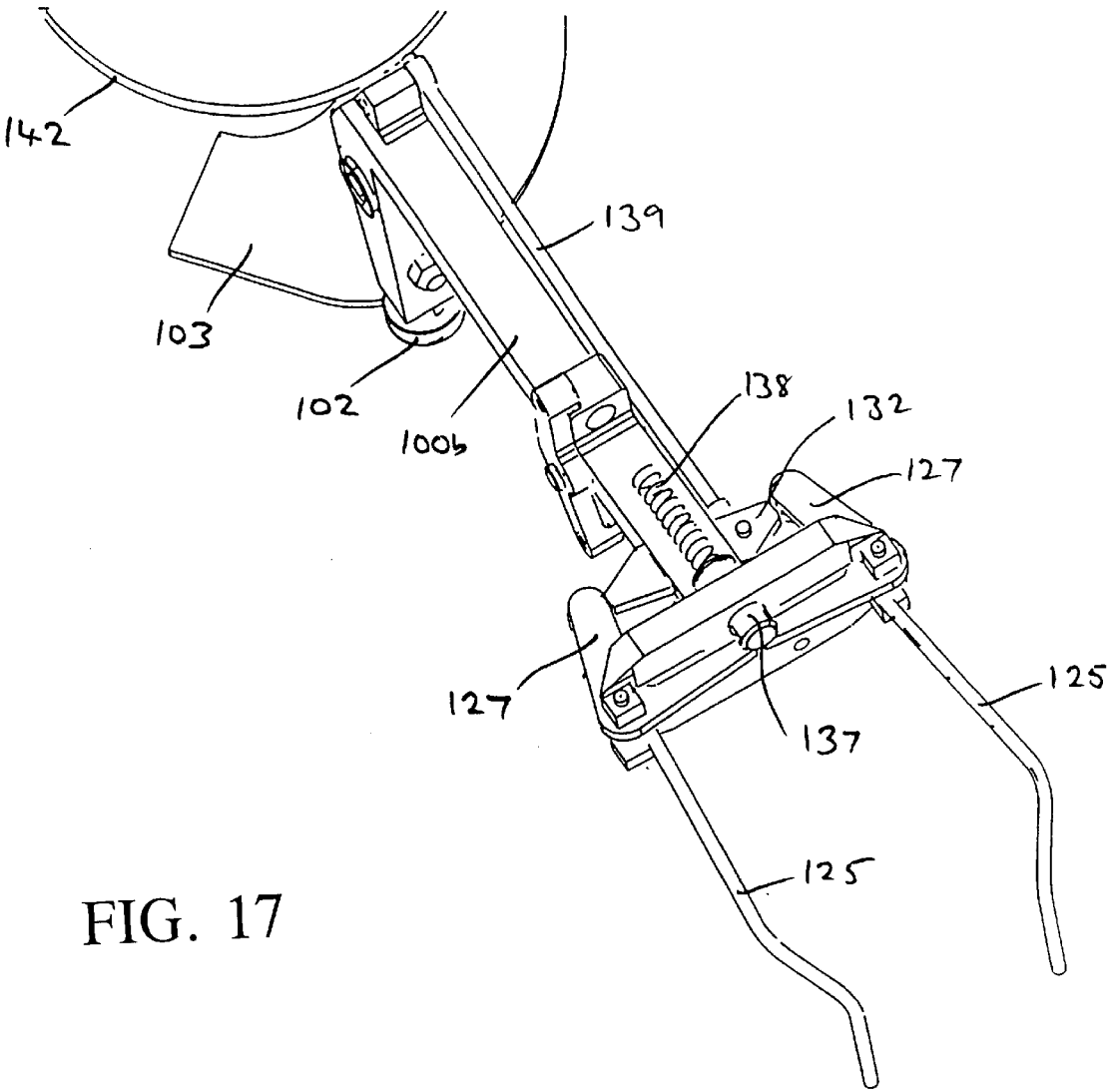

250°: The fingers are reset to their closed position by engagement of the resetting rod 139 with the cam disc 142 (FIG. 17).

270°: The arm reaches its maximum height to clear the top seal mechanism.

315°: The arm starts to drop down.

360°: As 0°.

What is claimed is:

1. A packaging machine for continuous operation for forming, filling and sealing bags of a product comprising: means for forming a film into an elongate, side-sealed tube as it travels in a first direction, means for severing the elongate tube into individual, open-ended, bag-length elements, belt means for transporting the said elements in a second direction transverse to the first direction, means for forming a bottom seal on said elements to convert them into open-topped bags, a carousel in-line with said transporting means that are continuously moving for receiving the open-topped bags as the open-topped bags travel tangentially to said carousel at a speed substantially matching that of said carousel, so that the transport means transport said elements continuously onto said continuously moving carousel, and means for introducing product into each of the open-topped bags and for forming a top seal on each of the bags to convert them into filled, sealed bags, as the bags are moved round the carousel.

2. A machine according to claim 1, wherein said film is a heat-sealable film and wherein the means for forming the film into an elongate, side-sealed tube, comprises a tube-former for forming the film into the shape of a tube with overlapping longitudinal edge portions as it travels from a film supply, inner and outer pressure members which engage the inside and outside of the said edge portions and travel with them, and means for supplying heat to the said edge portions.

3. A machine according to claim 2, wherein the inner and outer pressure members are belts.

4. A machine according to claim 1, further comprising a pair of pinch rollers for engaging opposite faces of the side-sealed tube, at least one of the rollers having a pair of lands extending radially therefrom and arranged to engage the tube on either side of the side seal, the side seal itself being arranged to pass between the pinch rollers without pressure being exerted thereon.

5. A machine claim 1, wherein the said severing means comprises a pair of rotatable rollers disposed with their axes of rotation parallel to one another and offset by an acute angle from a direction at right angles to the direction of film travel, one of the rollers having an anvil surface, and the other of the rollers having an elongate cutting member adapted to cuttingly engage the said anvil surface, the cutting member running at a right angle to the direction of film travel.

6. A machine claim 1, wherein the means for transporting them in said second direction comprises a picker mechanism having means for receiving open-ended bag-length elements travelling in said first direction and means for gripping the said elements and causing them to move in said second direction.

7. A machine according to claim 6, wherein said gripping means comprises at least one travelling belt.

8. A machine according to claims 6, further comprising means for accelerating each individual bag-length element before it enters the picker mechanism, whereby to space the elements from one another and present each element separately to the picker mechanism.

9. A machine according to claim 8, wherein the accelerating means comprises belts arranged to grip the said elements.

10. A machine according to claim 1, further comprising a pair of opening means which exert a vacuum force on opposite sides of the open-topped bag and which travel in diverging directions whereby to open the top of the bags to prepare them for the introduction of product.

11. A machine according to claim 1, wherein said product introducing means comprises fingers adapted to enter the open top of each bag, and movable from a position in which said fingers can enter the open top to a position in which said fingers are further away from one another and hold the open top, and a chute formed of a plurality of members which are movable with respect to one another, in a direction transverse to a direction of movement of said finger, from a configuration in which the chute can enter the open bag top to an expanded configuration in which product can enter the bag therethrough.

12. A machine according to claim 11, wherein the chute comprises a first, radially inner chute member and a second, radially outer chute member, the first and second chute members being movable radially towards and away from one another as the chute travels around the carousel.

13. A machine according to claim 12, wherein the chute is mounted on the distal end of a generally radially extending arm.

14. A machine according to claim 13, wherein the arm is pivotally movable about an axis transverse to its length and to its axis of movement about the carousel, and means are provided for controlling said pivotal movement.

15. A machine according to claim 13, further comprising a compression spring for biassing the fingers apart, the spring acting between a first member attached to the inner chute member and means for moving the fingers apart, whereby the biassing force is greater when the inner chute member is at a radially inner position and the cup is closed than when the inner chute member is at a radially outer position and the cup is open.

16. A machine according to claim 15, further comprising trigger means, operable by pivotal movement of said arm, to cause the fingers to move away from one another.

17. A machine according to claim 13, further comprising a plurality of arms extending radially from a common axis of rotation and rotating in unison thereabout.

18. A packaging machine for forming, filling and sealing bags with a product comprising: means for forming a film into an elongate, side-sealed tube as it travels in a first direction, means for severing the elongate tube into individual, open-ended bag-length elements, means for forming a bottom seal on said elements to convert them into open-topped bags, a carousel arranged to receive the open-topped bags, transporting means for continuously transporting said elements in a second direction transverse to said first direction and tangential to said carousel to introduce said elements tangentially to said carousel at a speed substantially matching that of said carousel whereby the transporting means transports said elements continuously onto said continuously moving carousel, and means for introducing product into each of the open-topped bags and for forming a top seal on each of the bags to convert them into filled, sealed bags as the bags are moved around the carousel; said transporting means comprising a picker mechanism having gripper means for receiving open-ended bag length elements traveling in said first direction and for gripping said elements to cause them to move in said second direction, said gripping means comprising at least one traveling belt.

19. A machine according to claim 18, wherein said film is a heat-sealable film and wherein the means for forming the film into an elongate, side-sealed tube, comprises a tube former for forming the film into the shape of a tube with overlapping longitudinal edge portions as it travels from a film supply, inner and outer pressure members which engage the inside and outside of said edge portions and travel with them, and means for supplying heat to said edge portions.

20. A machine according to claim 19, wherein the inner and outer pressure members are belts.

21. A machine according to claim 18, further comprising a pair of pinch rollers for engaging opposite faces of the side-sealed tube, at least one of the rollers having a pair of lands extending radially therefrom and arranged to engage the tube on either side of the side seal, the side seal itself being arranged to pass between the pinch rollers without pressure being exerted thereon.

22. A machine according to claim 18, wherein the said severing means comprises a pair of rotatable rollers disposed with the axes of rotation parallel to one another and offset by an acute angle from a direction at right angles to the direction of film travel, one of the rollers having an anvil surface, and the other of the rollers having an elongate cutting member adapted to cuttingly engage the said anvil surface, the cutting member running at a right angle to the direction of film travel.

23. A machine according to claim 18, further comprising means for accelerating each individual bag-length element before it enters the picker mechanism, whereby to space the elements from one another and present each element separately to the picker mechanism.

24. A machine according to claim 18, wherein the accelerating means comprises belts arranged to grip the said elements.

25. A machine according to claim 18, wherein said product introducing means comprises fingers adapted to enter the open top of each bag, and movable from a position in which said fingers can enter the open top to a position in which said fingers are further away from one another and hold the open top, and a chute formed of a plurality of members which are movable with respect to one another, in a direction transverse to a direction of movement of said finger, from a configuration in which the chute can enter the open bag top to an expanded configuration in which product can enter the bag therethrough.

26. A machine according to claim 25, wherein the chute comprises a first, radially inner chute member and a second, radially outer chute member, the first and second chute members being movable radially towards and away from one another as the chute travels around the carousel.

27. A machine according to claim 26, wherein the chute is mounted on the distal end of a generally radially extending arm.

* * * * *